US007637973B2

(12) United States Patent
Oh et al.

(10) Patent No.: US 7,637,973 B2
(45) Date of Patent: Dec. 29, 2009

(54) VACUUM CLEANER IN WHICH A DUST BAG OR A CYCLONE DUST COLLECTING APPARATUS IS SELECTIVELY MOUNTED

(75) Inventors: Jang-keun Oh, Gwangju (KR); Seung-yong Cha, Gwangju (KR); Jin-gon Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 12/217,538

(22) Filed: Jul. 7, 2008

(65) Prior Publication Data

US 2009/0223188 A1 Sep. 10, 2009

(30) Foreign Application Priority Data

Mar. 5, 2008 (KR) ..... 10-2008-0020614

(51) Int. Cl.
*B01D 50/00* (2006.01)

(52) U.S. Cl. ..... 55/337; 55/429; 55/DIG. 3; 55/318; 55/319; 55/447; 55/385.1; 15/353; 15/352; 15/328; 15/350; 15/347

(58) Field of Classification Search ..... 55/337, 55/429, DIG. 3, 318–319, 385.1; 15/347, 15/350, 353, 352, 328, 323
See application file for complete search history.

(56) References Cited

U.S. PATENT DOCUMENTS 3,621,640 A * 11/1971 Ohno et al. ..... 55/300
3,636,681 A * 1/1972 Batson et al. ..... 55/372
3,778,863 A * 12/1973 Westergren et al. ..... 15/323
4,545,794 A * 10/1985 Himukai ..... 55/362
4,699,641 A * 10/1987 Barnes, Jr. ..... 55/480
5,135,552 A * 8/1992 Weistra ..... 55/337
5,464,460 A * 11/1995 Bosses ..... 55/374
5,699,585 A * 12/1997 Tomooka et al. ..... 15/327.2

(Continued)

FOREIGN PATENT DOCUMENTS

GB 2321181 7/1998

(Continued)

OTHER PUBLICATIONS

Extended European Search Report dated Jun. 26, 2009 corresponding to European Patent Application No. 08171994.0-2314.

*Primary Examiner*—Jason M Greene
*Assistant Examiner*—Dung Bui
(74) *Attorney, Agent, or Firm*—Ohlandt, Greeley, Ruggiero & Perle, L.L.P.

(57) ABSTRACT

A vacuum cleaner, in which a dust bag or a cyclone dust collecting apparatus can be selectively mounted, includes a body case having a dust collecting chamber and a connecting hole formed at a side surface of the dust collecting chamber so that outside air enters through the connecting hole, a pair of securing brackets formed on an inner surface of the dust collecting chamber of the body case at both sides of the connecting hole in parallel with each other so that the cyclone dust collecting apparatus or the dust bag is selectively secured to the pair of securing brackets, and a body cover disposed at the body case and being opened and closed in order to open and close the dust collecting chamber.

16 Claims, 9 Drawing Sheets

U.S. PATENT DOCUMENTS

| | | | | |
|---|---|---|---|---|
| 5,740,581 | A * | 4/1998 | Harrelson, II | 15/314 |
| 5,778,487 | A * | 7/1998 | Schuld | 15/352 |
| 5,935,279 | A * | 8/1999 | Kilstrom | 55/337 |
| 6,256,834 | B1 * | 7/2001 | Meijer et al. | 15/352 |
| 6,374,452 | B1 * | 4/2002 | Essex et al. | 15/323 |
| 6,398,834 | B2 * | 6/2002 | Oh | 55/424 |
| 6,934,994 | B2 * | 8/2005 | Oh et al. | 15/328 |
| 7,332,008 | B2 * | 2/2008 | Oh et al. | 55/396 |
| 7,419,521 | B2 * | 9/2008 | Oh et al. | 55/337 |
| 7,480,959 | B2 * | 1/2009 | Bott et al. | 15/323 |
| 2002/0011053 | A1 * | 1/2002 | Oh | 55/426 |
| 2002/0046438 | A1 * | 4/2002 | Oh | 15/353 |
| 2002/0088078 | A1 * | 7/2002 | Oh et al. | 15/327.1 |
| 2003/0182756 | A1 * | 10/2003 | Duggan | 15/347 |
| 2005/0011037 | A1 * | 1/2005 | Zhao et al. | 15/323 |
| 2005/0229554 | A1 * | 10/2005 | Oh et al. | 55/346 |
| 2006/0016043 | A1 * | 1/2006 | Matsuhashi et al. | 15/353 |
| 2006/0156506 | A1 * | 7/2006 | Bott et al. | 15/323 |
| 2007/0067945 | A1 * | 3/2007 | Kasper et al. | 15/353 |
| 2007/0079580 | A1 * | 4/2007 | Oh | 55/345 |
| 2007/0095034 | A1 * | 5/2007 | Han et al. | 55/459.3 |
| 2007/0130895 | A1 * | 6/2007 | Boeck et al. | 55/429 |
| 2007/0289263 | A1 * | 12/2007 | Oh et al. | 55/318 |
| 2007/0289266 | A1 * | 12/2007 | Oh | 55/337 |
| 2008/0092326 | A1 * | 4/2008 | Morishita | 15/352 |
| 2008/0184893 | A1 * | 8/2008 | Oh et al. | 96/416 |
| 2008/0190080 | A1 * | 8/2008 | Oh et al. | 55/343 |
| 2008/0289306 | A1 * | 11/2008 | Han et al. | 55/422 |

FOREIGN PATENT DOCUMENTS

| | | |
|---|---|---|
| GB | 2394649 | 5/2004 |
| JP | 2006-346277 | 12/2006 |
| KR | 10-0613483 | 8/2006 |
| KR | 1020070018285 | 2/2007 |
| WO | WO01/82767 | 11/2001 |

* cited by examiner

VACUUM CLEANER IN WHICH A DUST BAG OR A CYCLONE DUST COLLECTING APPARATUS IS SELECTIVELY MOUNTED

CROSS-REFERENCE TO RELATED APPLICATIONS

This application claims the benefit under 35 U.S.C. §119 (a) from Korean Patent Application No. 2008-20614 filed Mar. 5, 2008 in the Korean Intellectual Property Office, the disclosure of which is incorporated herein by reference in its entirety.

BACKGROUND OF THE INVENTION

1. Field of the Invention

The present disclosure relates to a vacuum cleaner. More particularly, the present disclosure relates to a vacuum cleaner in which a dust bag or a cyclone dust collecting apparatus can be selectively mounted so that a user can select the cyclone dust collecting apparatus or the dust bag as a dust collecting apparatus.

2. Description of the Related Art

Generally, a vacuum cleaner generates a suction force, draws in contaminants such as dust, hairs, etc. (hereinafter, referred to dust) with air using the suction force, separates dust from the drawn-in air, and discharges cleaned air to the outside, thereby performing a cleaning operation.

Accordingly, the vacuum cleaner is provided with a dust collecting apparatus that can separate dust from the drawn-in air and collect the separated dust. Dust bags, cyclone dust collecting apparatuses, etc. can be used as the dust collecting apparatus.

However, the conventional vacuum cleaner is generally configured to use only one kind of dust collecting apparatus. That is, the vacuum cleaner being configured to use a dust bag as the dust collecting apparatus cannot use the cyclone dust collecting apparatus. Contrarily, the vacuum cleaner being adapted to use the cyclone dust collecting apparatus as the dust collecting apparatus cannot use the dust bag. Thus, the conventional vacuum cleaner is not configured so that users select and use one of various different types of dust collecting apparatuses according to their needs. Therefore, the use of the vacuum cleaner can be inconvenient.

SUMMARY OF THE INVENTION

The present disclosure has been developed in order to overcome the above drawbacks and other problems associated with the conventional arrangement. An aspect of the present disclosure is to provide a vacuum cleaner in which a user can select one of a dust bag and a cyclone dust collecting apparatus and mount it in the vacuum cleaner for collection of dust therein.

The above aspect and/or other feature of the present disclosure can substantially be achieved by providing a vacuum cleaner in which a dust bag or a cyclone dust collecting apparatus can be selectively mounted. The vacuum cleaner includes a body case having a dust collecting chamber and a connecting hole formed at a side surface of the dust collecting chamber so that outside air enters through the connecting hole; a pair of securing brackets formed on an inner surface of the dust collecting chamber of the body case at both sides of the connecting hole in parallel with each other so that the cyclone dust collecting apparatus or the dust bag is selectively secured to the pair of securing brackets; and a body cover disposed at the body case, the body cover being opened and closed in order to open and close the dust collecting chamber.

The body case may include a sealing member disposed at the connecting hole of the dust collecting chamber; wherein when the cyclone dust collecting apparatus is mounted in the dust collecting chamber, the sealing member contacts an air entering pipe of the cyclone dust collecting apparatus, and when the dust bag is mounted in the dust collecting chamber, the sealing member contacts a securing plate of the dust bag.

A front surface of the sealing member may be configured to form an obtuse angle with respect to a bottom surface of the dust collecting chamber.

The cyclone dust collecting apparatus may include a pair of hooking members, and when the cyclone dust collecting apparatus is inserted in the dust collecting chamber, the pair of hooking members is configured to be hooked on the pair of securing brackets disposed on the dust collecting chamber.

The cyclone dust collecting apparatus may be adapted to draw in and discharge the outside air via the lower portion thereof.

The cyclone dust collecting apparatus may include a cyclone body configured so that the outside air upwardly whirls and dust is separated from the outside air; a dust collecting container configured to enclose around the cyclone body, the dust collecting container to collect the dust separated in the cyclone body; an air entering pipe connected with the lower portion of the cyclone body through the dust collecting container, the air entering pipe to guide the outside air entering through the connecting hole to the lower portion of the cyclone body; and an air-discharging pipe disposed at a center of the cyclone body, the air-discharging pipe to discharge the outside air having the dust removed to the lower portion of the cyclone body; wherein the pair of hooking members is disposed on the dust collecting container at both sides of the air entering pipe.

An end of the air entering pipe may be formed to have an angle corresponding to a front surface of the sealing member.

The cyclone dust collecting apparatus may include a filter member disposed at a side of the dust collecting container, and the filter member is in fluid communication with the air-discharging pipe.

The cyclone dust collecting apparatus may include a cyclone cover that is detachably disposed at an upper portion of the dust collecting container.

The cyclone cover may include a cover handle disposed on a top surface of the cyclone cover.

The cyclone cover may be formed of a transparent material.

The cyclone dust collecting apparatus may be configured so that the dust separated in the cyclone body is discharged into the dust collecting container over a top end of the cyclone body.

The dust bag may include a securing plate being hooked on the pair of securing brackets.

The body cover may include an accessory chamber.

The body cover may include an accessory chamber cover to cover the accessory chamber.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the exemplary embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined in the description, such as a detailed construction and elements thereof, are provided to assist in a comprehensive understanding of the disclosure. Thus, it is apparent that the present disclosure may be carried out without those defined matters. Also, well-known functions or constructions are omitted to provide a clear and concise description of exemplary embodiments of the present disclosure.

Figure 1:
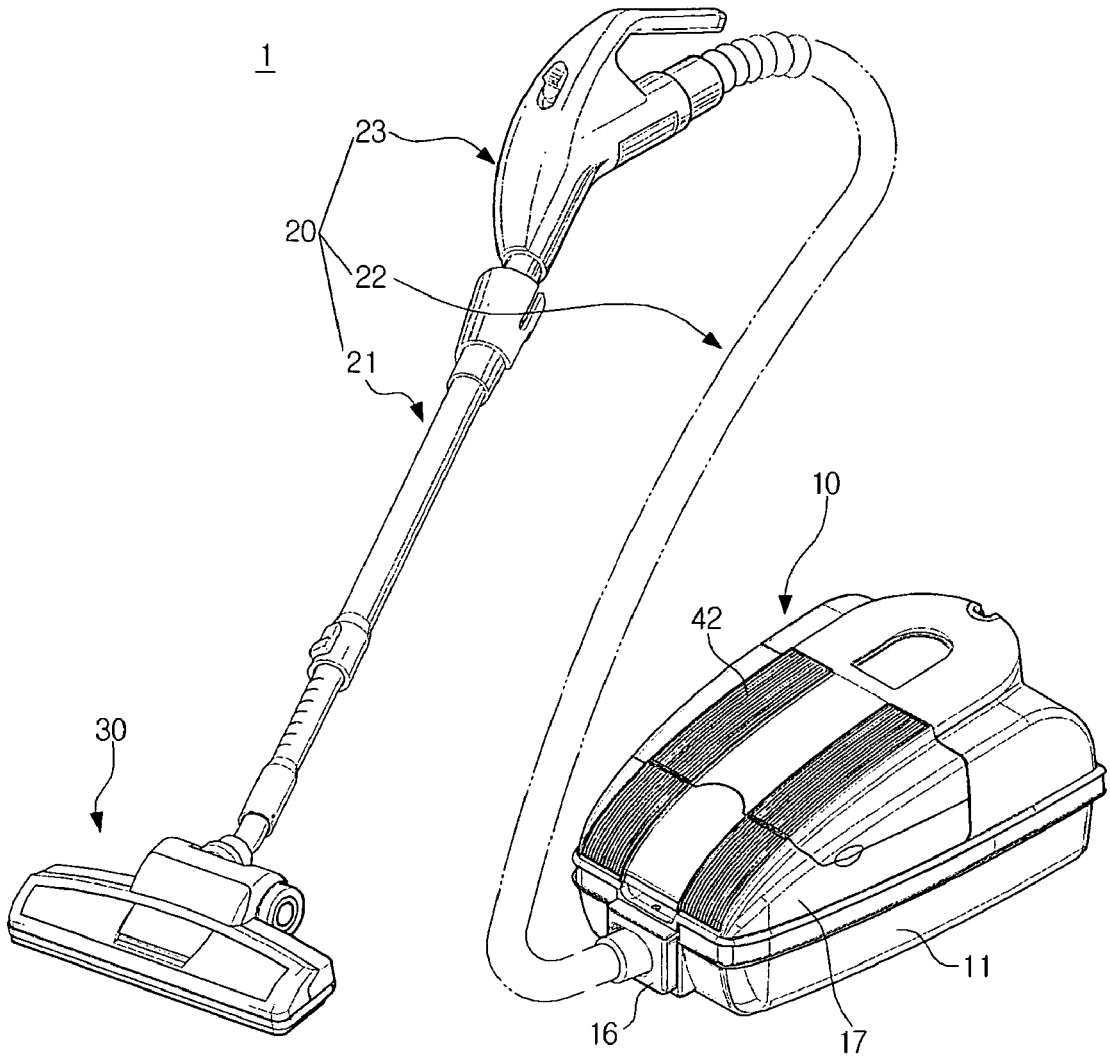
FIG. 1 is a perspective view illustrating a vacuum cleaner according to an exemplary embodiment of the present disclosure.
Figure 2:
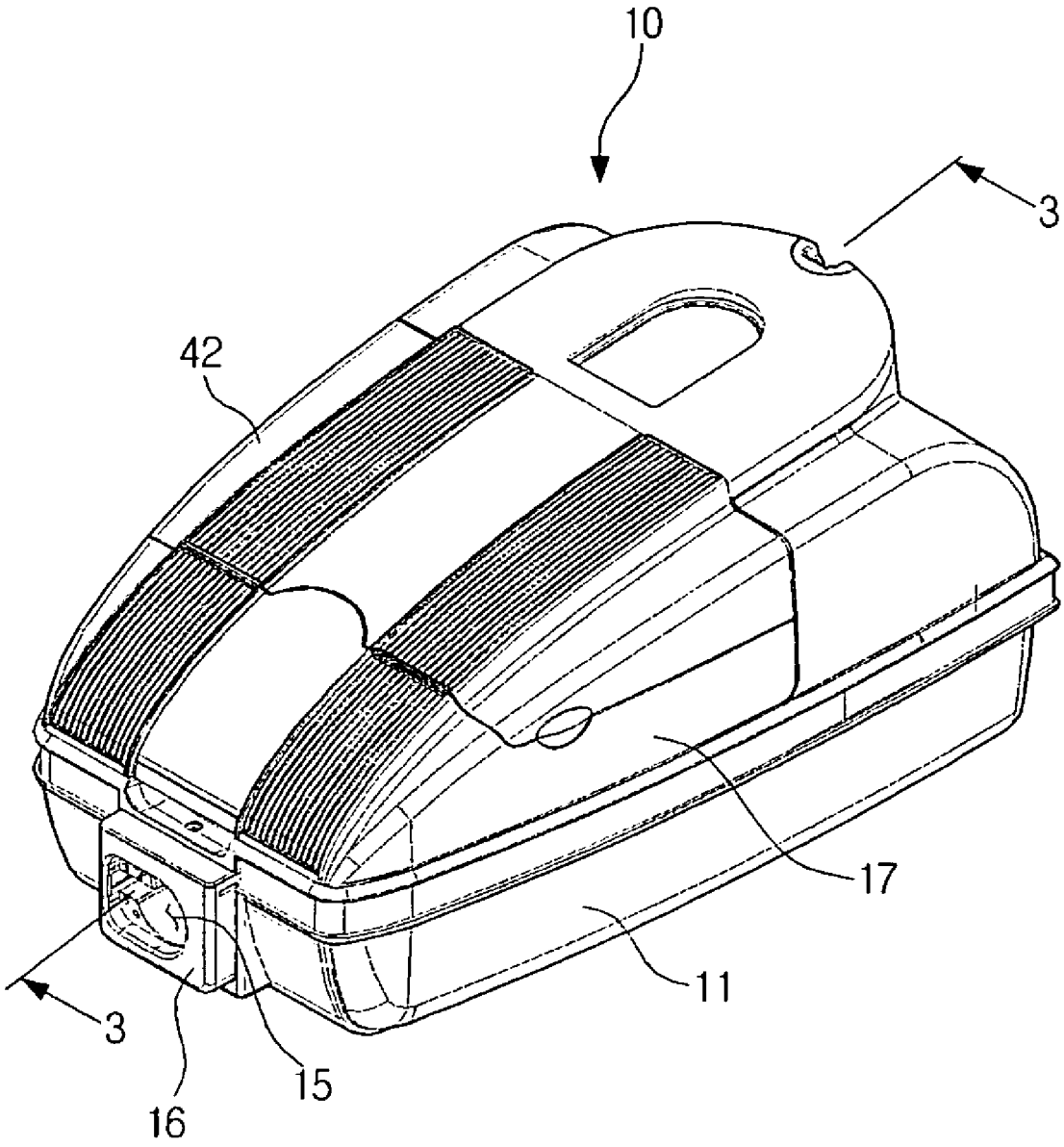
FIG. 2 is a perspective view illustrating a cleaner body of the vacuum cleaner of FIG. 1 from which an extension pipe assembly and a suction nozzle are separated.
Figure 3:
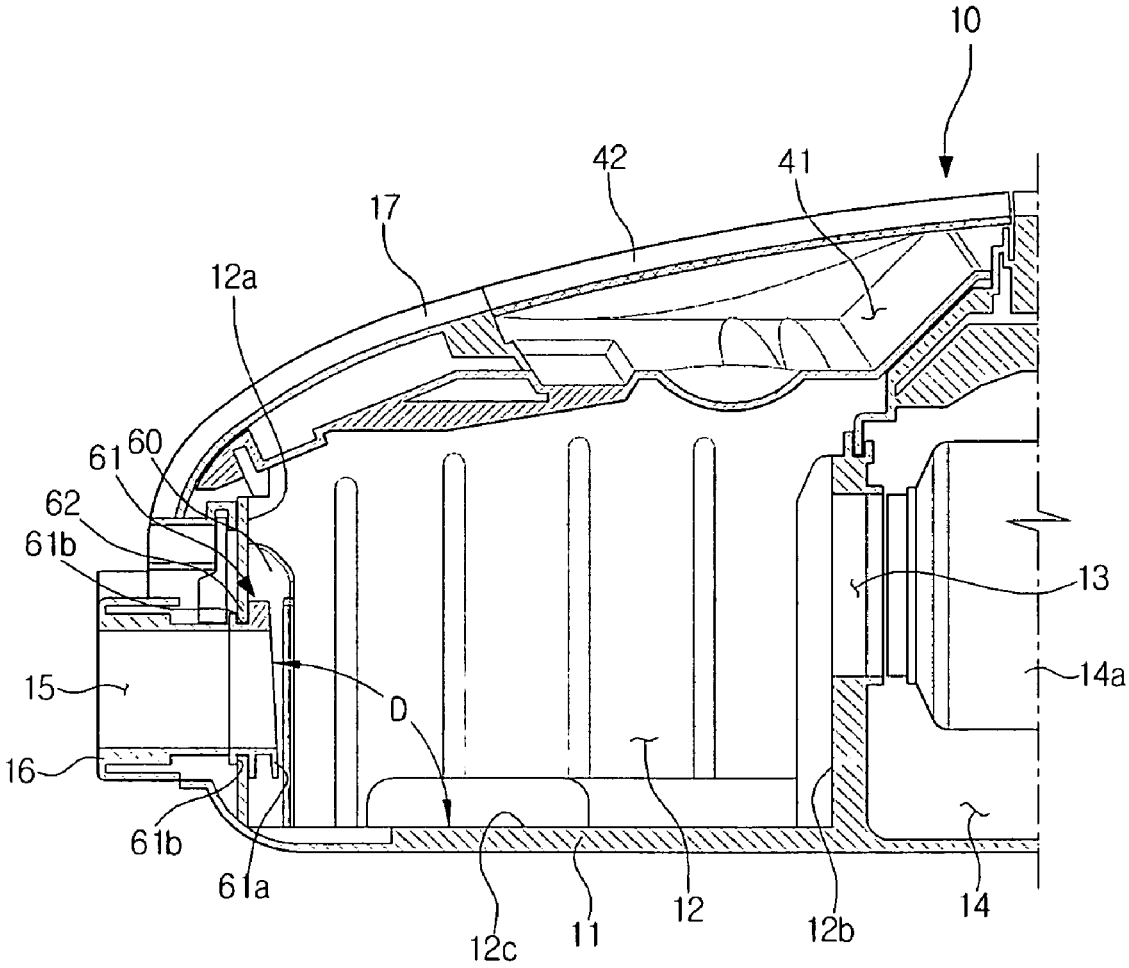
FIG. 3 is a partial sectional view illustrating the cleaner body of FIG. 2 taken along a line 3-3 in FIG. 2 when a dust collecting apparatus is not mounted in a dust collecting chamber of the cleaner body.

FIG. 1 is a perspective view illustrating a vacuum cleaner 1 according to an exemplary embodiment of the present disclosure. FIG. 2 is a perspective view illustrating a cleaner body 10 of the vacuum cleaner 1 of FIG. 1 from which an extension pipe assembly 20 and a suction nozzle 30 are separated. FIG. 3 is a partial sectional view illustrating the cleaner body 10 of FIG. 2 taken along a line 3-3 in FIG. 2 when a dust collecting apparatus, such as a cyclone dust collecting apparatus 50 and a dust bag 70, is not mounted in a dust collecting chamber 12 of the cleaner body 10.

Referring to FIG. 1, the vacuum cleaner 1 according to an exemplary embodiment of the present disclosure includes the cleaner body 10, the extension pipe assembly 20, and the suction nozzle 30.

Referring to FIGS. 2 and 3, the cleaner body 10 includes a body case 11. Inside the body case 11 are formed a dust collecting chamber 12 and a motor chamber 14.

The dust collecting chamber 12 is formed in a space where a dust collecting apparatus, such as a cyclone dust collecting apparatus 50 and a dust bag 70, can be disposed. The dust collecting chamber 12 has an open top end so that the dust collecting apparatus 50 and 70 can be vertically mounted into or separated from the dust collecting chamber 12. A connecting hole 15 is formed at a first inner surface 12*a* of the dust collecting chamber 12 corresponding to a front side of the body case 11. The connecting hole 15 allows the front side of the body case 11 to be in fluid communication with the dust collecting chamber 12.

Figure 4:
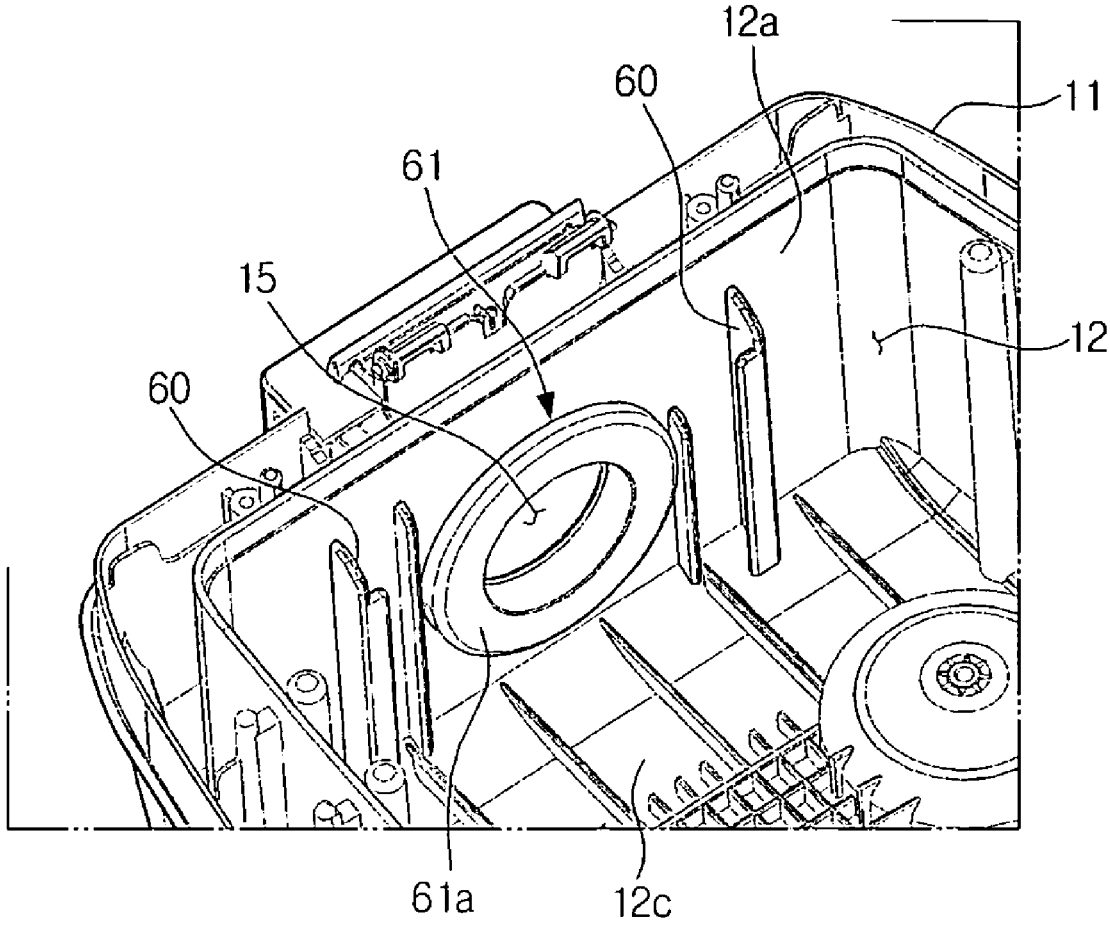
FIG. 4 is a partial perspective view illustrating a pair of securing brackets disposed in the dust collecting chamber of the cleaner body of FIG. 3.

As illustrated in FIG. 4, a pair of securing brackets 60 is formed on the first inner surface 12*a* of the dust collecting chamber 12 of the body case 11 at which the connecting hole 15 is formed. The pair of securing brackets 60 is formed at both sides of the connecting hole 15 in parallel with each other. The pair of securing brackets 60 is formed to fix a cyclone dust collecting apparatus 50 or a dust bag 70 that is disposed inside the dust collecting chamber 12. In this exemplary embodiment, the pair of securing brackets 60 is formed substantially in the shape of the letter "L" as illustrated in FIG. 4. However, the shape of the pair of securing brackets 60 as illustrated in FIG. 4 is only one example. In fact, as long as the securing brackets 60 can fix the cyclone dust collecting apparatus 50 and the dust bag 70 to the dust collecting chamber 12, the securing brackets 60 can be formed in various shapes.

Figure 5:
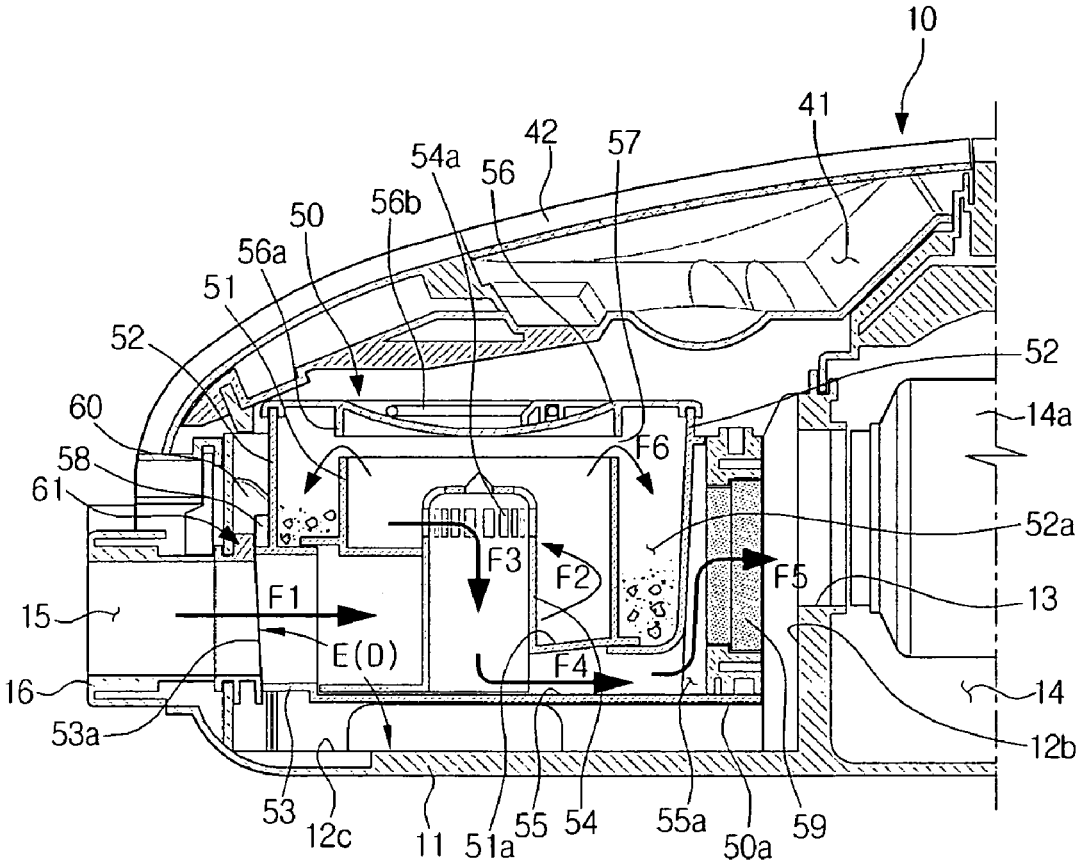
FIG. 5 is a partial sectional view illustrating the cleaner body of FIG. 3 when a cyclone dust collecting apparatus is mounted in the dust collecting chamber of the cleaner body.
Figure 8:
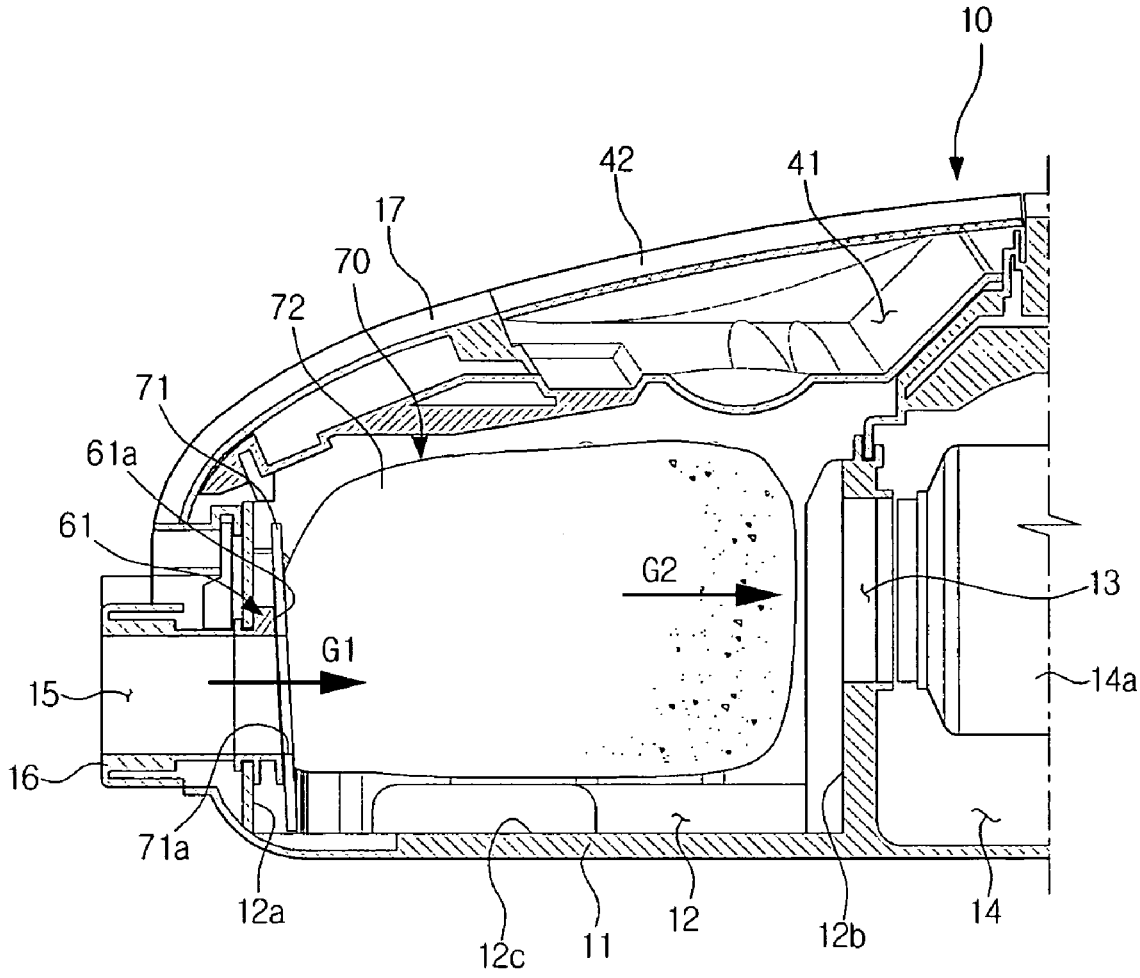
FIG. 8 is a partial sectional view illustrating the cleaner body of FIG. 3 when a dust bag is mounted in the dust collecting chamber of the cleaner body.

A sealing member 61 is substantially formed in a hollow cylindrical shape and disposed in the connecting hole 15. When the cyclone dust collecting apparatus 50 is mounted in the dust collecting chamber 12, as illustrated in FIG. 5, a front surface 61*a* of the sealing member 61 contacts an entering end 53*a* of an air entering pipe 53 of the cyclone dust collecting apparatus 50. On the other hand, when the dust bag 70 is mounted in the dust collecting chamber 12, as illustrated in FIG. 8, the front surface 61*a* of the sealing member 61 contacts a securing plate 71 of the dust bag 70. As a result, when the cyclone dust collecting apparatus 50 or the dust bag 70 is mounted in the dust collecting chamber 12, the sealing member 61 prevents air entering through the connecting hole 15 from leaking. Accordingly, the sealing member 61 may be formed of an elastic material such as a rubber, etc.

On the other hand, the front surface 61*a* of the sealing member 61, as illustrated in FIG. 3, may be configured to form an obtuse angle D with respect to a bottom surface 12*c* of the dust collecting chamber 12. If the front surface 61*a* of the sealing member 61 forms an obtuse angle D with respect to the bottom surface 12*c* of the dust collecting chamber 12, it is convenient that the cyclone dust collecting apparatus 50 or the dust bag 70 is vertically mounted in the dust collecting chamber 12. Also, as illustrated in FIG. 3, the sealing member 61 may have a securing groove 61*b* formed at a rear end of the sealing member 61. The securing groove 61*b* of the sealing member 61 is inserted in a securing protrusion 62 that is formed in the first inner surface 12*a* of the dust collecting chamber 12 to correspond to the connecting hole 15. When the securing groove 61*b* of the sealing member 61 is inserted in the securing protrusion 62 of the first inner surface 12*a* of the dust collecting chamber 12, the sealing member 61 is fixed to the first inner surface 12*a* of the dust collecting chamber 12.

A mounting portion 16 to which the flexible hose 22 of the extension pipe assembly 20 is coupled is formed around the connecting hole 15 of the front side of the body case 11.

An air-communicating hole 13 is formed in a side surface of the dust collecting chamber 12, that is, a second inner surface 12*b* of the dust collecting chamber 12 that faces the connecting hole 15. The air-communicating hole 13 is configured to allow the dust collecting chamber 12 to be in fluid communication with the motor chamber 14. At the air-communicating hole 13 may be disposed a motor filter (not illustrated) that filters air being discharged from the dust collecting apparatus 50 and 70. Inside the motor chamber 14 is disposed the motor assembly 14*a* that generates a suction force. The motor assembly 14*a* can use any conventional motor assembly usable with a vacuum cleaner. Therefore, a detailed description of the motor assembly 14*a* is omitted.

The dust collecting apparatus, namely cyclone dust collecting apparatus 50 and dust bag 70, is detachably mounted inside the dust collecting chamber 12. The vacuum cleaner 1 according to an exemplary embodiment of the present disclosure can use the cyclone dust collecting apparatus 50 and the dust bag 70 as the dust collecting apparatus. That is, either of the cyclone dust collecting apparatus 50 or the dust bag 70 can be mounted inside the dust collecting chamber 12. Therefore, a user can mount the cyclone dust collecting apparatus 50 in the dust collecting chamber 12 of the body case 11. When the user's need changes, the user can separate the cyclone dust collecting apparatus 50 from the dust collecting chamber 12 of the body case 11, and then mount the dust bag 70 therein instead of the cyclone dust collecting apparatus 50.

The cyclone dust collecting apparatus 50 that can be mounted in the vacuum cleaner 1 according to an exemplary embodiment of the present disclosure may be configured so that outside air enters via a lower portion of the cyclone dust collecting apparatus 50, dust is separated from the outside air, and then cleaned air is discharged via the lower portion of the cyclone dust collecting apparatus 50. Also, the cyclone dust collecting apparatus 50 that can be mounted in the vacuum cleaner 1 according to an exemplary embodiment of the present disclosure may be configured so that a first direction (F1 in FIG. 5) in which the outside air enters the cyclone dust collecting apparatus 50 is the same as a second direction (F5 in FIG. 5) in which the cleaned air is discharged from the cyclone dust collecting apparatus 50. That is, the cyclone dust collecting apparatus 50 may be configured so that the first direction of the outside air F1 entering the cyclone dust collecting apparatus 50 and the second direction of the cleaned air F5 discharged from the cyclone dust collecting apparatus 50 become substantially parallel.

Figure 6:
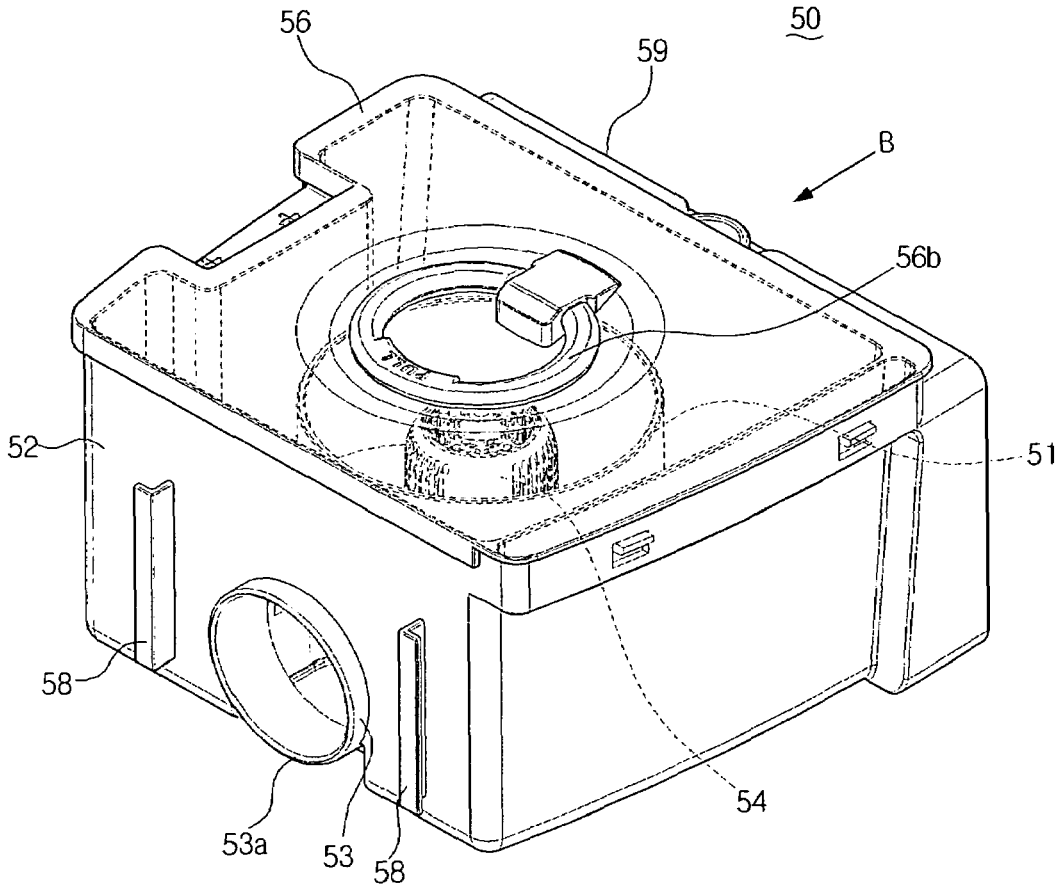
FIG. 6 is a perspective view illustrating the cyclone dust collecting apparatus being mounted in the cleaner body of FIG. 5.
Figure 7:
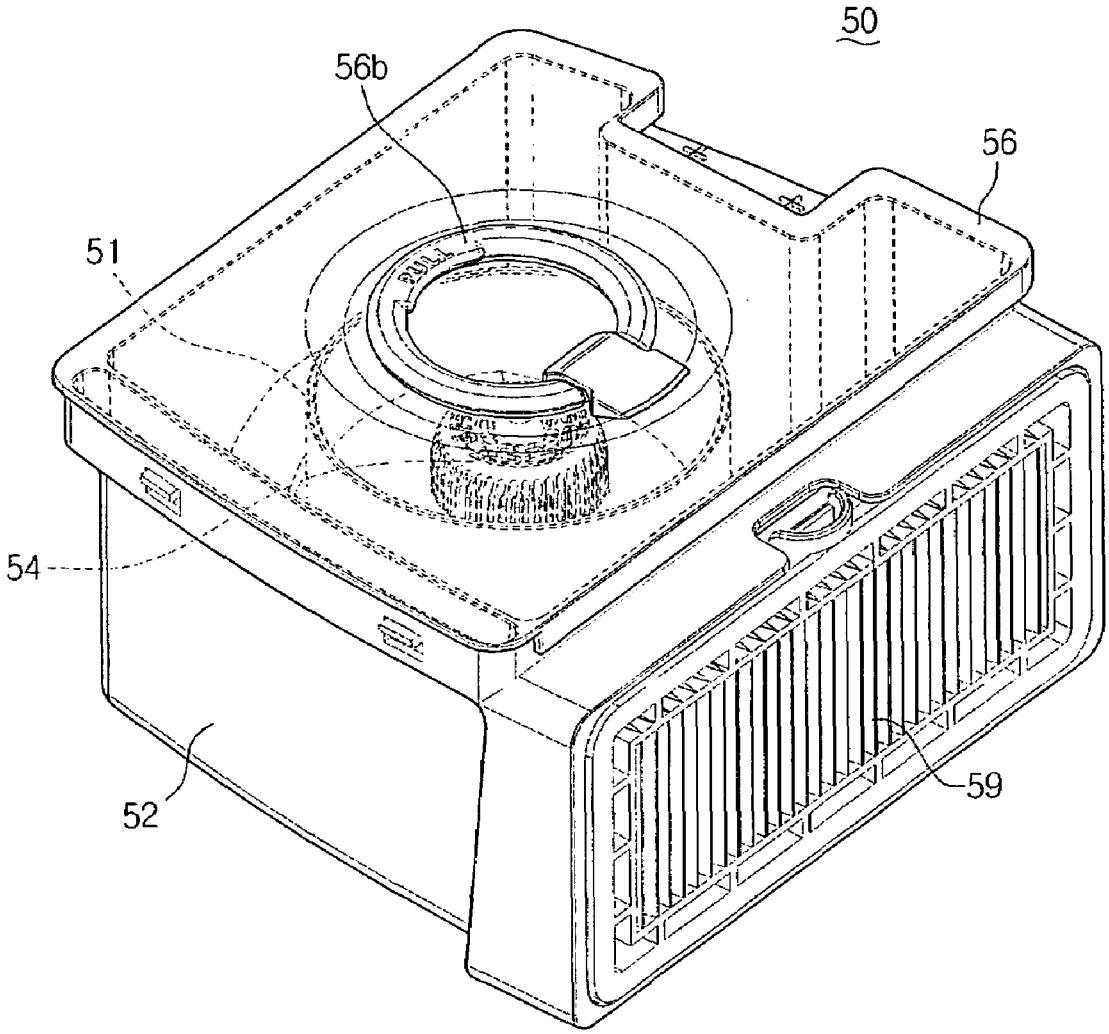
FIG. 7 is a perspective view illustrating the cyclone dust collecting apparatus of FIG. 6 looking in a direction of arrow B in FIG. 6.

FIG. 5 illustrates the cyclone dust collecting apparatus 50 mounted in the vacuum cleaner 1 according to an exemplary embodiment of the present disclosure. FIGS. 6 and 7 are a perspective view illustrating the cyclone dust collecting apparatus 50 being mounted in the vacuum cleaner 1 of FIG. 5.

Referring to FIGS. 5 to 7, the cyclone dust collecting apparatus 50 includes a cyclone body 51, a dust collecting container 52, the air entering pipe 53, and an air-discharging pipe 54.

The cyclone body 51 is formed substantially in a hollow cylindrical shape. A sloping surface 51*a* is formed in a bottom of the cyclone body 51 and allows the outside air entering via the air entering pipe 53 to rise up while whirling. Therefore, while the outside air entering the cyclone body 51 rises up and whirls, dust is separated from the outside air by a centrifugal force.

The dust collecting container 52 is formed to enclose the cyclone body 51 and to be spaced apart from the cyclone body 51. The dust collecting container 52 is formed to have a height higher than that of the cyclone body 51. Therefore, the dust, that is separated by the centrifugal force inside the cyclone body 51, is discharged over a top end of the cyclone body 51 and collected in a dust collecting space 52*a* between the dust collecting container 52 and the cyclone body 51.

The air entering pipe 53 is disposed to connect with the lower portion of the cyclone body 51 through the dust collecting container 52. Therefore, the outside air entering through the connecting hole 15 is guided into the lower portion of the cyclone body 51 through the air entering pipe 53, and rises up and whirls inside the cyclone body 51. The air entering pipe 53, as illustrated in FIG. 6, is disposed so that the entering end 53*a* thereof projects from an outer surface of the dust collecting container 52. Also, the entering end 53*a* of the air entering pipe 53, as illustrated in FIG. 5, may be configured to form an obtuse angle E with respect to a bottom surface 50*a* of the cyclone dust collecting apparatus 50 or the bottom surface 12*c* of the dust collecting chamber 12. At this time, as illustrated in FIG. 5, the angle E of the entering end 53*a* of the air entering pipe 53 may be formed to correspond to the inclined angle D of the front surface 61*a* of the sealing member 61.

A pair of hooking members 58, as illustrated in FIG. 6, may be disposed on the dust collecting container 52 at both sides of the entering end 53*a* of the air entering pipe 53. The pair of hooking members 52 may be formed so that when the cyclone dust collecting apparatus 50 is inserted into the dust collecting chamber 12 of the body case 11, the hooking members 58 are hooked on the pair of securing brackets 60 formed on the first inner surface 12*a* of the dust collecting chamber 12. Therefore, each of the pair of hooking members 58, as illustrated in FIG. 6, may be formed substantially in the shape of the letter "L" corresponding to the pair of securing brackets 60. However, this does not limit the shape of hooking members 58.

The air-discharging pipe 54 is disposed at an approximate center of the cyclone body 51, and discharges cleaned air, which has dust removed in the cyclone body 51, to the lower portion of the cyclone body 51. The air-discharging pipe 54 is formed substantially in a hollow cylindrical shape. A plurality of air holes 54*a* through which the cleaned air having dust removed in the cyclone body 51 enters is formed at an upper portion of the air-discharging pipe 54. A bottom end of the air-discharging pipe 54 is connected with an air-discharging pathway 55 being formed in the lower portion of the cyclone body 51. The air-discharging pathway 55 is formed so that the cleaned air is discharged in the same direction as the direction in which the air F1 flows through the air entering pipe 53. That is, as illustrated in FIG. 5, the entering end 53*a* of the air entering pipe 53 is formed to face the first inner surface 12*a* of the dust collecting chamber 12, and a discharging end 55*a* of the air-discharging pathway 55 is formed to face the second inner surface 12*b* of the dust collecting chamber 12. Therefore, the discharging end 55*a* of the air-discharging pathway 55 is formed on a side surface opposite to the side surface of the cyclone dust collecting apparatus 50 on which the entering end 53*a* of the air entering pipe 53 is formed.

A filter member 59 may be disposed between the discharging end 55*a* of the air-discharging pathway 55 and the first inner surface 12*b* of the dust collecting chamber 12. The filter member 59 filters off fine dust remaining in the cleaned air being discharged from the cyclone dust collecting apparatus 50. The filter member 59, as illustrated in FIG. 7, may detachably be disposed at a side of the dust collecting container 52.

A cyclone cover 56 may be disposed at a top end of the dust collecting container 52 so as to be opened or closed. A backflow preventing dam 56*a* may be formed on a bottom surface of the cyclone cover 56. A cover handle 56*b* may be formed on a top surface of the cyclone cover 56. When the cyclone cover 56 closes the top end of the dust collecting container 52, the dust collecting space 52*a* inside the dust collecting container 52 is insulated from outside, and a gap 57 is formed between the top end of the cyclone body 51 and the backflow preventing dam 56*a* disposed on the bottom surface of the cyclone cover 56. The dust separated in the cyclone body 51 by the centrifugal force is discharged into the dust collecting space 52*a* through the gap 57 over the top end of the cyclone body 51 in the direction of arrow F6 in FIG. 5.

The cover handle 56*b* formed on the cyclone cover 56 may be used for mounting the cyclone dust collecting apparatus 50 in the dust collecting chamber 12 of the body case 11 and separating the cyclone dust collecting apparatus 50 from the dust collecting chamber 12. Also, the cover handle 56*b* of the cyclone cover 56 may be used for mounting the cyclone cover 56 on the dust collecting container 52 or separating the cyclone cover 56 from the dust collecting container 52.

Furthermore, the cyclone cover 56 may be made of a transparent material. When the cyclone cover 56 is made of the transparent material, the user can see the quantity of dust being collected in the dust collecting container 52.

A body cover 17 is disposed at the body case 11 above the dust collecting chamber 12 so as to be opened or closed. When the body cover 17 is opened, the dust collecting chamber 12 is exposed. Therefore, after the user opens the body cover 17, the user can mount the cyclone dust collecting apparatus 50 or the dust bag 70 in the dust collecting chamber 12 of the body case 11 or separate the cyclone dust collecting apparatus 50 or the dust bag 70 from the dust collecting chamber 12.

Also, as illustrated in FIG. 3, an accessory chamber 41 may be formed in the body cover 17. The accessory chamber 41 may receive various accessory suction nozzles (not illustrated) such as crevice cleaning tools, etc. that can clean specific places such as corners of a room where the standard suction nozzle 30 cannot draw in dust except a broad surface such as a floor. An accessory chamber cover 42 may be disposed at the body cover 17 above the accessory chamber 41 so as to be opened and closed. When the accessory chamber cover 42 is opened, the accessory chamber 41 is exposed. Therefore, when the accessory suction nozzle is required, the user can open the accessory chamber cover 42, pick out the accessory suction nozzle, and use it to clean.

Figure 9:
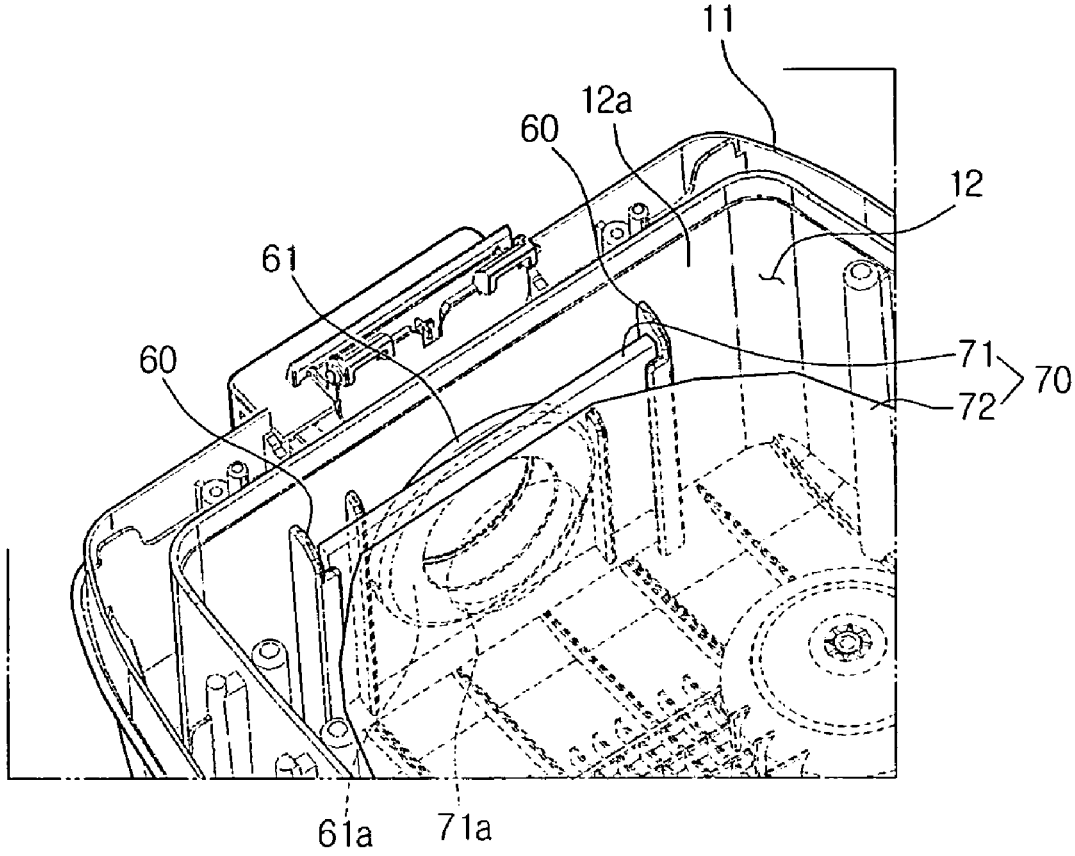
FIG. 9 is a partial perspective view illustrating a connection of a securing plate of a dust bag and a pair of securing brackets being disposed in the dust collecting chamber of the cleaner body of FIG. 3.

FIG. 8 illustrates the cleaner body 10 that has the dust bag 70 disposed in the dust collecting chamber 12 of the body case 11 thereof The dust bag 70 includes a bag portion 72 receiving dust and the securing plate 71. The securing plate 71 is disposed at a leading end of the bag portion 72 and secured to the pair of securing brackets 60 of the body case 11. An entering opening 71*a* is formed at the securing plate 71 to correspond the connecting hole 15 of the body case 11. The dust laden outside air enters the bag portion 72 through the entering opening 71*a*. For mounting the dust bag 70 in the dust collecting chamber 12 of the body case 11, as illustrated in FIG. 9, the securing plate 71 of the dust bag 70 is inserted between the pair of securing brackets 60 disposed in the dust collecting chamber 12 of the body case 11. When the securing plate 71 of the dust bag 70 is disposed between the pair of the securing brackets 60, the securing plate 71 of the dust bag 70 contacts the front surface 61*a* of the sealing member 61 so that the outside air entering through the connecting hole 15 of the body case 11 does not leak between the securing plate 71 of the dust bag 70 and the front surface 61*a* of the sealing member 61.

The extension pipe assembly 20 includes an extension pipe 21 and a flexible hose 22. An end of the flexible hose 22 is fixed to the mounting portion 16 formed around the connecting hole 15 of the cleaner body 10. The other end of the flexible hose 22 is connected with the extension pipe 21. An extension pipe handle 23 may be disposed between the extension pipe 21 and the flexible hose 22.

The suction nozzle 30 is connected with an end of the extension pipe 21, and includes a dust suction opening (not illustrated) that draws in outside air having dust from the surface to be cleaned. The outside air entering through the dust suction opening moves into the cleaner body 10 through the extension pipe 21 and the flexible hose 22 of the extension pipe assembly 20.

Hereinafter, operation of the vacuum cleaner 1 according to an exemplary embodiment of the present disclosure having the structure as described above with reference to FIGS. 1, 5, and 8.

When mounting the cyclone dust collecting apparatus 50 in the cleaner body 10, the user opens the body cover 17 and inserts the cyclone dust collecting apparatus 50 into the dust collecting chamber 12 of the body case 11. At this time, the cyclone dust collecting apparatus 50 is inserted so that the entering end 53*a* of the air entering pipe 53 of the cyclone dust collecting apparatus 50 faces the sealing member 61 disposed on the first inner surface 12*a* of the dust collecting chamber 12 and the filter member 59 of the cyclone dust collecting apparatus 50 faces the second inner surface 12*b* of the dust collecting chamber 12. When the cyclone dust collecting apparatus 50 is mounted in the dust collecting chamber 12, the entering end 53*a* of the air entering pipe 53 contacts the front surface 61*a* of the sealing member 61 and the filter member 59 faces the second inner surface 12*b* of the dust collecting chamber 12. After the cyclone dust collecting apparatus 50 is mounted in the dust collecting chamber 12, the body cover 17 is closed.

When turning on the vacuum cleaner 1, the motor assembly 14*a* in the motor chamber 14 operates to generate the suction force. The suction force draws in dust laden outside air from the surface to be cleaned through the suction nozzle 30. The outside air being drawn-in into the suction nozzle 30 enters the connecting hole 15 of the body case 11 through the extension pipe 21 and the flexible hose 22. The outside air entering the connecting hole 15 moves into the lower portion of the cyclone body 51 through a hollow portion of the sealing member 61 and the air entering pipe 53 of the cyclone dust collecting apparatus 50, and then, rises up while whirling (arrows F1 and F2 in FIG. 5). When the outside air whirls upwardly, dust is separated form the outside air by the centrifugal force. The separated dust rises up along the cyclone body 51, and is discharged into the dust collecting space 52*a* through the gap 57 between the backflow preventing dam 56*a* and the top end of the cyclone body 51 (arrow F6 in FIG. 5).

Cleaned air having dust separated enters the air-discharging pipe 54 through the plurality of air holes 54*a* as arrow F3 illustrated in FIG. 5. The cleaned air entering the air-discharging pipe 54 flows to the filter member 59 through the air-discharging pathway 55 as arrows F4 and F5. The cleaned air that has fine dust filtered while passing the filter member 59 enters the motor chamber 14. The cleaned air entering the motor chamber 14 passes the motor assembly 14*a*, and then is discharged to the outside of the cleaner body 10.

After opening the body cover 17, the user can check out how much dust is collected in the dust collecting container 52 of the cyclone dust collecting apparatus 50 through the transparent cyclone cover 56. When the dust is filled up, the user grips the cover handle 56*b* and takes out the cyclone dust collecting apparatus 50 from the dust collecting chamber 12. After that, the cyclone cover 56 is separated from the dust collecting container 52 so that the top end of the dust collecting container 52 is opened. Then, by turning downward the dust collecting container 52 the dust collected in the dust collecting container 52 can be easily thrown away.

After re-mounting the cyclone cover 56 on the top end of the dust collecting container 52, the user can again insert and mount the cyclone dust collecting apparatus 50 in the dust collecting chamber 12 of the cleaner body 10.

When the user wants to use the dust bag 70 instead of the cyclone dust collecting apparatus 50 as the dust collecting apparatus, the user can replace the cyclone dust collecting apparatus 50 mounted in the cleaner body 10 with the dust bag 70. Hereinafter, a process in which the cyclone dust collecting apparatus 50 mounted in the cleaner body 10 is replaced with the dust bag 70 will be explained.

First, the user opens the body cover 17, and takes out the cyclone dust collecting apparatus 50 mounted in the dust collecting chamber 12 of the body case 11. At this time, usage of the cover handle 56*b* disposed at the cyclone cover 56 of the cyclone dust collecting apparatus 50 may provide an easy separation of the cyclone dust collecting apparatus 50.

Next, the dust bag 70 is mounted in the dust collecting chamber 12 of the body case 11. At this time, opposite side ends of the securing plate 71 of the dust bag 70, as illustrated in FIG. 9, should be hooked on the pair of securing brackets 60 of the dust collecting chamber 12. So the securing plate 71 is fixed to the dust collecting chamber 12 of the body case 11 by the pair of securing brackets 60 and the sealing member 61 and the entering opening 71*a* of the securing plate 71 is in fluid communication with the connecting hole 15 of the body case 11. After mounting the dust bag 70 finishes, the body cover 17 is closed.

When turning on the vacuum cleaner 1 in this state, the motor assembly 14*a* disposed in the motor chamber 14 operates to generate the suction force. The suction force draws in outside air having dust from the surface to be cleaned into the suction nozzle 30. The outside air being drawn-in into the suction nozzle 30 enters the connecting hole 15 of the body case 11 through the extension pipe 21 and the flexible hose 22. The outside air entering the connecting hole 15 moves into the bag portion 72 of the dust bag 70 through the entering opening 71*a* of the securing plate 71 (arrow G1 in FIG. 8). While the outside air passes the dust bag 70, dust being contained in the outside air remains in the bag portion 72, and only cleaned air passes out through the bag portion 72 (arrow G2). The air being cleaned while passing the dust bag 70 enters the motor chamber 14 through the air communicating hole 13. So the cleaned air is discharged the outside of the cleaner body 10 via the motor chamber 14.

As described above, the vacuum cleaner 1 according to an exemplary embodiment of the present disclosure has the dust collecting chamber 12 of the body case 11 in which both the cyclone (lust collecting apparatus 50 and the dust bag 70 can be disposed. Therefore, the user can mount anyone of the cyclone dust collecting apparatus 50 or the dust bag 70 in the dust collecting chamber 12 of the body case 11 as desired. That is, the vacuum cleaner 1 according to an exemplary embodiment of the present disclosure is formed so that the cyclone dust collecting apparatus 50 and the dust bag 70 can be used interchangeably with each other as the dust collecting apparatus.

With the vacuum cleaner according to an exemplary embodiment of the present disclosure having the structure as described above, the body case is formed in the structure that both the cyclone dust collecting apparatus and the dust bag can be mounted. Therefore, the user can select and use either of the cyclone dust collecting apparatus or the dust bag as the dust collecting apparatus as desired.

Also, because the vacuum cleaner according to an exemplary embodiment of the present disclosure uses the cyclone dust collecting apparatus having a structure allowing to draw in and discharge air through the lower portion thereof as the dust collecting apparatus, it has dust collecting efficiency higher than that of the vacuum cleaner using a cyclone dust collecting apparatus having other structure.

Also, because the vacuum cleaner according to an exemplary embodiment of the present disclosure uses the cyclone dust collecting apparatus having a structure allowing the upper portion thereof to be opened and closed, when emptying dust collected in the cyclone dust collecting apparatus, an amount of dust blowing off is small and emptying dust is easy.

Furthermore, because the cyclone dust collecting apparatus being used in the vacuum cleaner according to an exemplary embodiment of the present disclosure has the cover handle disposed at the upper portion thereof, it is easy that the cyclone dust collecting apparatus is mounted to and separated from the body case.

Also, because the vacuum cleaner according to an exemplary embodiment of the present disclosure has the accessory chamber being formed in the body cover, it is convenient to have the custody of the accessory suction nozzles.

While the exemplary embodiments of the present disclosure have been described, additional variations and modifications of the exemplary embodiments may occur to those skilled in the art once they learn of the basic inventive concepts. Therefore, it is intended that the appended claims shall be construed to include both the above exemplary embodiments and all such variations and modifications that fall within the spirit and scope of the disclosure.

What is claimed is:

1. A vacuum cleaner in which a dust bag or a cyclone dust collecting apparatus can be selectively mounted, the vacuum cleaner comprising:

a body case having a dust collecting chamber and a connecting hole formed at a side surface of the dust collecting chamber so that outside air enters through the connecting hole;

a pair of securing brackets formed on an inner surface of the dust collecting chamber of the body case at both sides of the connecting hole in parallel with each other so that the cyclone dust collecting apparatus or the dust bag can be selectively secured to the pair of securing brackets; and a body cover disposed at the body case, the body cover being opened and closed in order to open and close the dust collecting chamber, wherein the cyclone dust collecting apparatus comprises a pair of hooking members which are configured to be hooked on the pair of securing brackets disposed on the dust collecting chamber when the cyclone dust collecting apparatus is inserted in the dust collecting chamber, if the cyclone dust collecting apparatus is used, the cyclone dust collecting apparatus is secured with the pair of securing brackets, and if the dust bag is used, the dust bag is secured with the pair of securing brackets.

2. The vacuum cleaner of claim 1, wherein the body case comprises a sealing member disposed at the connecting hole of the dust collecting chamber;

wherein when the cyclone dust collecting apparatus is mounted in the dust collecting chamber, the sealing member contacts an air entering pipe of the cyclone dust collecting apparatus, and when the dust bag is mounted in the dust collecting chamber, the sealing member contacts a securing plate of the dust bag.

3. The vacuum cleaner of claim 2, wherein the sealing member comprises a front surface configured to form an obtuse angle with respect to a bottom surface of the dust collecting chamber.

4. The vacuum cleaner of claim 1, wherein the body cover comprises an accessory chamber.

5. The vacuum cleaner of claim 4, wherein the body cover further comprises an accessory chamber cover to cover the accessory chamber.

6. A vacuum cleaner comprising:

a dust bag;

a cyclone dust collecting apparatus;

a body case having a dust collecting chamber and a connecting hole formed at a side surface of the dust collecting chamber so that outside air enters through the connecting hole;

a pair of securing brackets formed on an inner surface of the dust collecting chamber at sides of the connecting hole so that either a cyclone dust collecting apparatus or a dust bag can be selectively secured to the pair of securing brackets; and a body cover disposed at the body case, the body cover being opened and closed in order to open and close the dust collecting chamber, wherein if the cyclone dust collecting apparatus is used, the cyclone dust collecting apparatus is secured with the pair of securing brackets, and if the dust bag is used, the dust bag is secured with the pair of securing brackets.

7. The vacuum cleaner of claim 6, wherein the cyclone dust collecting apparatus comprises a pair of hooking members, and when the cyclone dust collecting apparatus is inserted in the dust collecting chamber, the pair of hooking members is configured to be hooked on the pair of securing brackets disposed on the dust collecting chamber.

8. The vacuum cleaner of claim 7, wherein the cyclone dust collecting apparatus is adapted to draw in and discharge the outside air via a lower portion thereof.

9. The vacuum cleaner of claim 8, wherein the cyclone dust collecting apparatus comprises:

a cyclone body configured so that the outside air upwardly whirls and dust is separated from the outside air;

a dust collecting container around the cyclone body to collect the dust separated by the cyclone body;

an air entering pipe connected with the lower portion of the cyclone body through the dust collecting container, the air entering pipe to guide the outside air entering through the connecting hole to the lower portion of the cyclone body; and an air-discharging pipe disposed at a center of the cyclone body, the air-discharging pipe to discharge the outside air having the dust removed.

10. The vacuum cleaner of claim 9, wherein the air entering pipe has an end formed with an angle corresponding to a front surface of the sealing member.

11. The vacuum cleaner of claim 10, wherein the cyclone dust collecting apparatus further comprises a filter member disposed at a side of the dust collecting container, and the filter member is in fluid communication with the air-discharging pipe.

12. The vacuum cleaner of claim 10, wherein the cyclone dust collecting apparatus further comprises a cyclone cover that is detachably disposed at an upper portion of the dust collecting container.

13. The vacuum cleaner of claim 12, wherein the cyclone cover comprises a cover handle disposed on a top surface of the cyclone cover.

14. The vacuum cleaner of claim 12, wherein the cyclone cover is formed of a transparent material.

15. The vacuum cleaner of claim 6, wherein the cyclone dust collecting apparatus is configured so that the dust separated in the cyclone body is discharged into the dust collecting container over a top end of the cyclone body.

16. The vacuum cleaner of claim 6, wherein the dust bag comprises a securing plate being hooked on the pair of securing brackets.

* * * * *